US005849134A

United States Patent [19]

Robichaud et al.

[11] Patent Number: 5,849,134

[45] Date of Patent: Dec. 15, 1998

[54] PROCESSING DISCRETE SHEETS OF MATERIAL

[75] Inventors: Arthur W. Robichaud, West Worthington; Timothy W. Duffy, Dublin, both of Ohio

[73] Assignee: Combibloc, Inc., Columbus, Ohio

[21] Appl. No.: 835,058

[22] Filed: Apr. 4, 1997

Related U.S. Application Data

[63] Continuation of Ser. No. 540,757, Oct. 11, 1995, abandoned.

[51] Int. Cl.[6] ..... B65C 9/25

[52] U.S. Cl. ..... 156/324; 156/238; 156/230; 156/235

[58] Field of Search ..... 271/3, 182, 183, 271/199, 202, 203, 270, 229, 230, 314, 216, 256, 215, 220, 224, 69, 214; 156/290, 304.1, 308.4, 324, 238, 235, 230, 234

[56] References Cited

U.S. PATENT DOCUMENTS

| | | | |
|---|---|---|---|
| 2,776,831 | 1/1957 | Shields | 414/797.6 X |
| 3,270,630 | 9/1966 | Frappier et al. | 414/797.6 X |
| 3,790,744 | 2/1974 | Bowen | 219/121 |
| 4,080,678 | 3/1978 | Muller | 11/1 D |
| 4,279,183 | 7/1981 | La Fleur | 83/16 |
| 4,285,513 | 8/1981 | Kwasnitza | 271/270 |
| 4,341,480 | 7/1982 | Mauler | 400/625 |
| 4,364,552 | 12/1982 | Besemoun | 271/182 |
| 4,440,051 | 4/1984 | Aykut | 83/72 |
| 4,548,404 | 10/1985 | Brandt et al. | 271/303 |
| 4,601,394 | 7/1986 | Hutner | 414/788.7 X |
| 4,680,442 | 7/1987 | Bauer et al. | 219/121 |
| 4,805,890 | 2/1989 | Martin | 271/203 |
| 4,945,203 | 7/1990 | Soodak et al. | 219/121.64 |
| 4,955,854 | 9/1990 | Roju | 225/103 |
| 5,001,325 | 3/1991 | Huizinga | 219/121.69 |
| 5,164,314 | 11/1992 | Paulson et al. | 83/29 |
| 5,197,364 | 3/1993 | Heutschi | 83/29 |
| 5,229,180 | 7/1993 | Littmann | 428/43 |
| 5,321,896 | 6/1994 | Brownewell et al. | 34/247 |
| 5,503,518 | 4/1996 | Scholz | 414/790.4 |

FOREIGN PATENT DOCUMENTS

| | | |
|---|---|---|
| 357841 | 3/1990 | European Pat. Off. . |
| 2161427 | 6/1985 | United Kingdom . |

*Primary Examiner*—Merrick Dixon
*Attorney, Agent, or Firm*—Standley & Gilcrest

[57] ABSTRACT

Discrete sheets are shingled to acquire lower speeds of material passage through a process application zone of the system while maintaining overall system throughput rates when compared to conventional web systems.

5 Claims, 2 Drawing Sheets

PROCESSING DISCRETE SHEETS OF MATERIAL

This application is a continuation of application Ser. No. 08/540,757 filed Oct. 11, 1995, now abandoned. This application is a continuation of U.S. patent application Ser. No. 08/489,356 filed Jun. 12, 1995 entitled A PROCESS AND SYSTEM FOR HANDLING DISCRETE SHEETS OF MATERIAL by Arthur W. Robichaud and Timothy W. Duffy.

BACKGROUND AND SUMMARY OF THE INVENTION

The present invention relates generally to a system for use in handling discrete sheets of material and more particularly to a process and system for rapidly processing discrete sheets of material.

Many process systems known today, use a continuous web feed of uncut material into a process zone where a process of some type will be performed on the material. For example, in the packaging industry, a continuous web of material is fed through a printing system, and later it is cut into individual packaging units to be folded into a desired package configuration. A newspaper printing press is another example of a continuous feed of material (i.e. paper) passing through a printing process, later to be cut into individual sections.

Of course, printing is not the only process that is incorporated into such systems, and paper is not the only kind of material that is continuously fed into such systems. Industry in general has applied many different processes to many different materials in continuous feed systems.

The known continuous material web systems, in some applications, suffer from certain drawbacks. For example, in many known web systems, whatever speed the material is moving at any point in the system, is the same average speed the material is moving at all other points in the system.

It is advantageous in certain process applications to slow the speed of the material at one point in the system, without slowing the material speed at all other points in the system. The present invention provides a process and system wherein shingled discrete sheets of material are supplied to a process. The source of the sheets may be a previously cut stack of sheets or a web system sheeter output having discrete sheets cut from a continuous web prior to entry into a process application. Shingling (overlapping) sheets of material slows the speed of the material through a process zone. The greater the overlap of the surface area of adjacent sheets the slower the speed will be. For example, an overlap of 50% enables the shingler to supply cards (discrete sheets) to a process zone at the same overall throughput rate as a web but at half the conventional web system speed. A higher percentage of overlap allows no loss in feed rate for the overall system, but offers the advantage of cards moving through the process at a slower speed. This slower speed is advantageous because many processes work better at slower tracking speeds. For example, paper passing through an ink jet printer may not be printed properly if it is passed through the ink jets at too high a speed. Labelers could also be operated at this lower speed while not capable of operation at full conventional web system rates.

It is to be appreciated that other processes such as electrostatic operations, gluing, ink jets, labeling, and any other operation that may be performed upon the shingled sheets are within the scope of the present invention.

These and other advantages will be apparent from the following detailed description of the invention, drawings, and claims.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENT(S)

Figure 1:
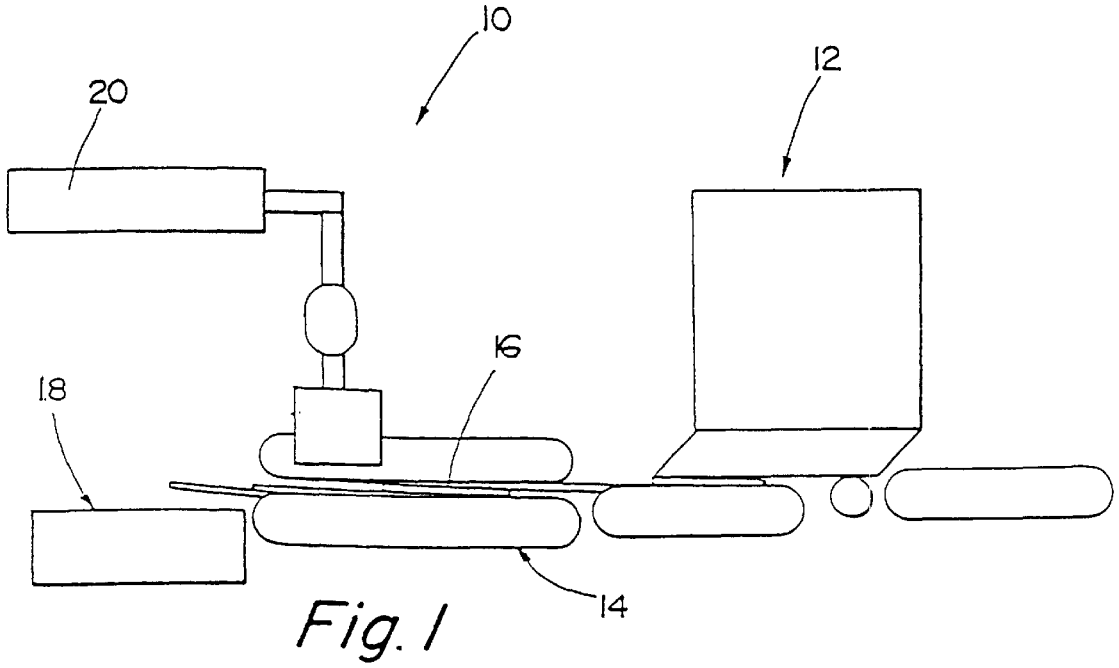
FIG. 1 is a side view of one preferred embodiment of the present invention.

Referring to FIG. 1, an embodiment of the present invention 10 is shown. This particular embodiment has a stack of sheets 12 and a shingling transfer/conveyor 14. The conveyor 14 conveys shingled sheets 16 to a down stacking elevator 18. While the shingled sheets 16 are being conveyed (constantly moving), a process 20 is performed on the sheets 16. Preferably, process 20 is a non-contact or a casual contact process, such as a laser, labeler, printer, coater, gluers, etc. It is to be understood that the source of sheets 12 may be a web sheeter, that is a web of material cut into discrete sheets prior to the process being applied, rather than a stack of sheets as shown in FIG. 1.

Figure 2:
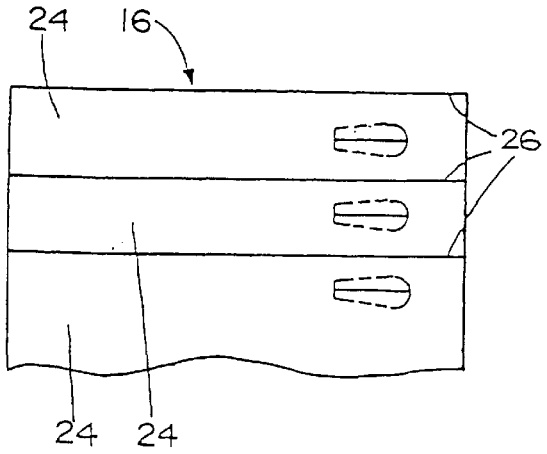
FIG. 2 is a top view of a shingled stack of material cards of the present invention.

FIG. 2 shows an overhead view of a portion of the shingled sheets 16. Each individual card or sheet may expose a portion of its surface 24 when shingled. Sensors may be utilized to detect a leading edge 26 of each card to trigger the application of the process 20 onto each card as each card passes a predetermined process application location in the overall system. Each individual card need only expose enough area to allow the process 20 to treat the respective, desired, exposed area.

Figure 3:
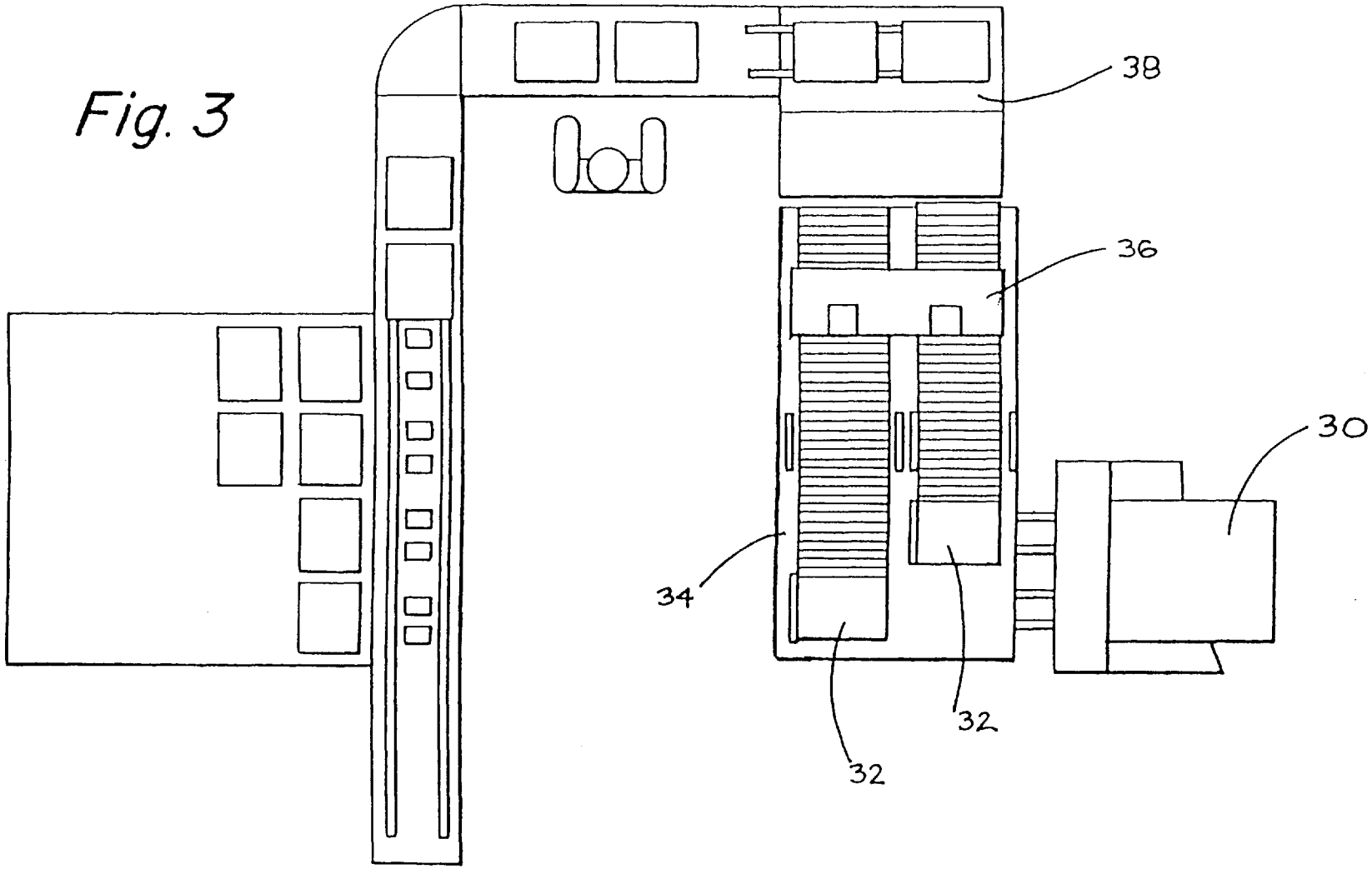
FIG. 3 is a top plan view of another embodiment of the present invention.

FIG. 3 shows another embodiment of the present invention. In this embodiment a continuous web of material 30 moving at a relatively high speed is cut into discrete sheets 32. The discrete sheets 32 are then forced onto a conveyor 34. The sheets may be placed on the conveyor at practically any desired orientation, including at ninety degrees right hand to the web, ninety degrees left hand to the web, or straight onto the conveyor in a line with the web. The sheets 32 preferably overlap a portion of each adjacent sheet on the conveyor 34. The conveyor speed is slower than the web speed.

An exposed portion of each sheet is then conveyed past a process device 36, and a process is performed on the exposed portion while the sheets 32 continue moving through the system. A collection device 38 or receiver may be positioned near the conveyor to collect the processed sheets.

The overlap of adjacent sheets allows the overall system output rate to remain unchanged, yet allows the discrete sheets to move at a slower speed through the process step, when compared to a system having a continuous material web all the way through the process step.

The present invention has been described in the form of several embodiments, but it is to be recognized that several modifications and variations to the invention could be made and fall within the scope of the subjoined claims.

What is claimed is:

1. A method of performing a repetitive process on discrete sheets of material, said method comprising the steps of:

conveying said discrete sheets in a continuously moving fashion through a path adjacent equipment to perform said process;

causing each of said discrete sheets to overlap a portion of each adjacent discrete sheet; and performing said process only on an exposed portion of each of said discrete sheets.

2. The method of claim 1, further comprising the step of providing a card feeder to supply said discrete sheets to said conveying step.

3. The method of claim 1 further comprising the step of providing a web sheeter to supply said discrete sheets to said conveying step.

4. The method of claim 1, wherein said process is not continuously performed on successive discrete sheets moving through said path.

5. The method of claim 1, further comprising the step of providing a sensor adapted to detect a leading edge of each discrete sheet to trigger said process.

* * * * *